United States Patent [19]

Tsuchihashi et al.

[11] 4,377,772

[45] Mar. 22, 1983

[54] DISCHARGE LAMP AND LIGHTING EQUIPMENT

[75] Inventors: Michihiro Tsuchihashi; Ryo Suzuki; Keiji Watanabe; Masato Saito, all of Kamakura, Japan

[73] Assignee: Mitsubishi Denki Kabushiki Kaisha, Tokyo, Japan

[21] Appl. No.: 201,914

[22] Filed: Oct. 29, 1980

[30] Foreign Application Priority Data

| | | | |
|---|---|---|---|
| Nov. 28, 1979 | [JP] | Japan | 54-164788[U] |
| Dec. 27, 1979 | [JP] | Japan | 54-170769 |
| Dec. 27, 1979 | [JP] | Japan | 54-170770 |

[51] Int. Cl.[3] ..... H01J 7/44

[52] U.S. Cl. ..... 315/63; 315/46; 315/182

[58] Field of Search ..... 315/125, 92, 75, 47, 315/46, 73, 182

[56] References Cited

U.S. PATENT DOCUMENTS

| | | | |
|---|---|---|---|
| 2,286,789 | 6/1942 | Dench | 315/47 |
| 2,923,856 | 2/1966 | Greene et al. | 315/DIG. 7 |
| 3,694,692 | 9/1972 | Pressman | 315/92 |
| 3,890,534 | 6/1975 | Horowitz | 315/92 |
| 4,091,307 | 5/1978 | McNamara | 315/182 |
| 4,135,114 | 1/1979 | Narikiyo | 315/47 |
| 4,170,744 | 10/1979 | Hansler | 315/90 |
| 4,278,916 | 7/1981 | Regan et al. | 315/92 |
| 4,287,454 | 9/1981 | Feuersanger et al. | 315/46 |

*Primary Examiner*—Harold A. Dixon

*Attorney, Agent, or Firm*—Oblon, Fisher, Spivak, McClelland & Maier

[57] ABSTRACT

A discharge lamp comprises an arc tube for high pressure discharge and a discharge gap for discharging until restarting the arc tube. The discharge gap being electrically connected in parallel to the arc tube in an outer bulb. A normally opened temperature responsive switch means is connected in series to the discharge gap and a series of the discharge gap and the temperature responsive switch means is connected in parallel to the arc tube.

24 Claims, 9 Drawing Figures

DISCHARGE LAMP AND LIGHTING EQUIPMENT

BACKGROUND OF THE INVENTION

1. Field of the Invention

The present invention relates to a novel discharge lamp which comprises an arc tube for high pressure discharge and a discharge gap for discharging until restarting the arc tube and the discharge gap being electrically connected in parallel to the arc tube in an outer bulb and a novel lighting equipment for operating the discharge lamp on a high frequency operating device.

2. Description of the Prior Arts

Recently, various lighting equipments for saving energy have been studied in view of energy saving.

Among various light sources, incandescent lamps have been mainly used, however overall efficacy is lowest. The requirement for saving energy as light sources is remarkably high. It has been desired to develop a light source having higher efficacy whereby the incandescent lamps can be replaced. The high pressure discharge lamps such as a high pressure mercury vapor discharge lamp, a metal halide vapor discharge lamp and a high pressure sodium vapor discharge lamp have each efficacy of 3 to 10 times of the efficacy of the incandescent lamp and have each configuration similar to that of the incandescent lamp. Therefore, it seems to be suitable to replace the incandescent lamps with the high pressure discharge lamps. In the case of high pressure discharge lamp, however, the pressure of mercury vapor in the arc tube during the steady operation of the lamp, reaches several atmospheres. When the lamp is extinguished by a transient voltage drop or a transient interruption of the power supply the lamp can not immediately initiate a discharge even though the power supply is recovered to the normal state. The lamp could not initiate a discharge again until the pressure of mercury vapor in the discharge lamp is lowered adequately in accordance with the decrease of arc tube temperature. The time from the extinction of the lamp to the restarting is referred to as a restarting time. The restarting time is required for 3 to 5 minutes in the case of the high pressure mercury vapor discharge lamp; for 8 to 15 minutes in the case of the metal halide vapor discharge lamp; and for 2 to 15 minutes in the case of the high pressure sodium vapor lamp. Such long restarting time causes trouble in replacing the incandescent lamp with said discharge lamps. When the high pressure discharge lamp is operated, a ballast is required. The ballast is in a large size and is placed out of the discharge lamp. It has been difficult to replace the incandescent lamp with a combination of the ballast and the discharge lamp in the practical application.

SUMMARY OF THE INVENTION

It is an object of the present invention to provide a novel discharge lamp which comprises an arc tube for high pressure discharge and a discharge gap for discharging until restarting the arc tube which is electrically connected in parallel to the discharge gap, in an outer bulb whereby the discharge is continued in the discharge gap until restarting the arc tube so as to prevent complete extinction of the discharge lamp.

Another object of the present invention is to provide a lighting equipment which is compact and has high efficacy and can be used instead of an incandescent lamp and which comprises an arc tube for high pressure discharge and a discharge gap for discharging until restarting the arc tube which is electrically connected in parallel to the discharge gap in an outer bulb of a discharge lamp and a high frequency operating device (a frequency of 1 KHz–100 KHz) for operating the lighting equipment in a form of one piece of the discharge lamp and the high frequency operating device to form one lamp, whereby the complete extinction of the discharge lamp is prevented by discharging in the discharge gap during the restarting time of the art tube after transient voltage drop following to the operation of the arc tube.

The other object of the present invention is to provide a novel discharge lamp which comprises an arc tube for high pressure discharge and a discharge gap for discharging until restarting the arc tube which is electrically connected in parallel to the discharge gap in an outer bulb in which mercury is kept and whose inner wall is coated with a phospher whereby the lamp is usually operated by the arc tube and the discharge is continued in the discharge gap during the restarting time of the arc tube to prevent the complete extinction of the discharge lamp by visible radiation resulted by the discharge and the fluorescent emission by the phospher on the inner wall of the outer bulb.

BRIEF DESCRIPTION OF THE DRAWINGS

FIG. 1 is a front view of a discharge lamp and FIG. 2 is a circuit diagram for the discharge lamp;

FIG. 4 is a front view of a discharge lamp and FIG. 5 is a circuit diagram for the discharge lamp;

FIG. 6 is a front view of a lighting equipment and FIG. 7 is a circuit diagram for the lighting equipment;

FIG. 8 is a front view of a lighting equipment and FIG. 9 is a circuit diagram for the lighting equipment.

DETAILED DESCRIPTION OF THE PREFERRED EMBODIMENTS

Figure 1:
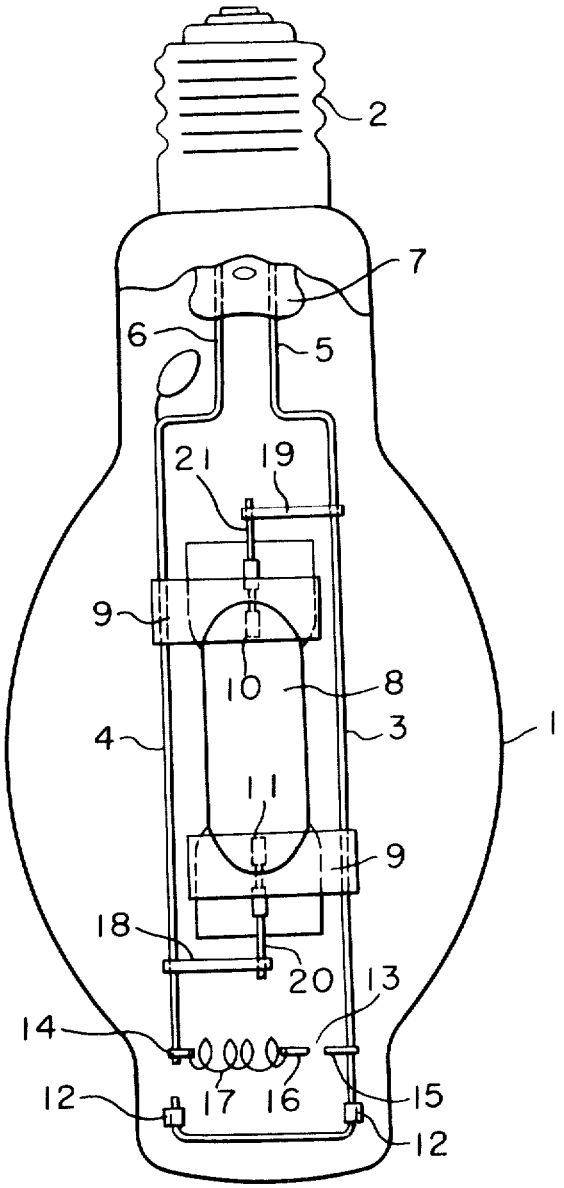
FIGS. 1 and 2 show a first embodiment of the present invention.
Figure 2:
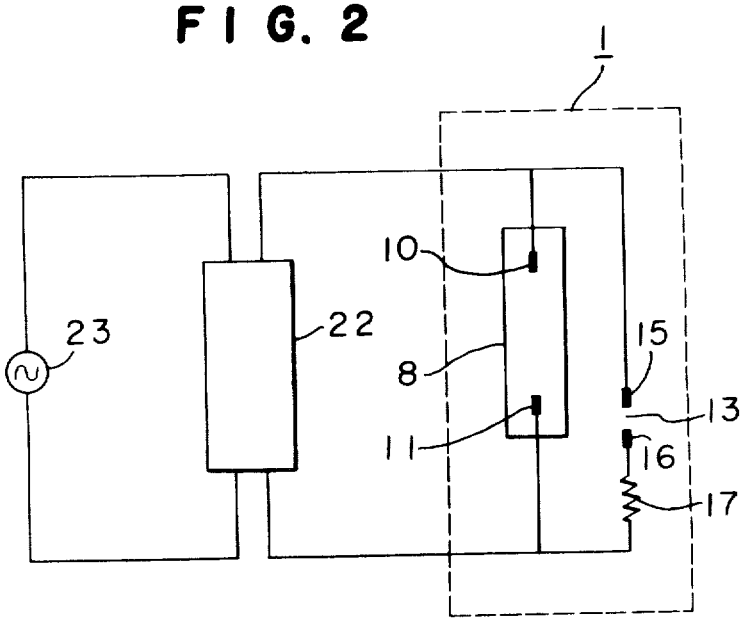

Referring to FIGS. 1 and 2, the first embodiment of the present invention will be illustrated. In the drawings, the reference numeral (1) designates an outer bulb made of radiation transmitting glass having a base (2) at one end; (3) and (4) designate support frames which are held by plate springs (12), (12) and are connected to the base (2) and respectively electrically connected to stem leads (5), (6) projected from a stem (7); (8) designates an arc tube for high pressure discharge as an arc tube of 400 W metal halide vapor discharge lamp which is held by metal caps (9), (9) which enhance temperature at each end and which are respectively held by the support frames (3), (4). A pair of electrodes (10), (11) are sealed at each end of the arc tube. One electrode (10) is electrically connected through a lead (21) and a ribbon lead (19) to the support frame (3) and the other electrode (11) is electrically connected through a lead (20) and a ribbon lead (18) to the support frame (4). The reference numeral (13) designates a discharge gap for discharge which is formed between an electrode (16) which is connected and held through a tungsten filament (17) as an impedance device and a lead (14) by the support frame (4) at the end and an electrode (15) connected and held by the support frame (3). Inside of the outer bulb (1), neon is filled under a pressure of 50 (torr). A distance between the electrodes (15), (16) of the discharge gap (13) is 3 (mm) and the tungsten filament (17) as the impedance element has the resistance of 180 (Ω). The series connection of the discharge gap (13) and the impedance element (17) is connected in parallel to the arc tube (8) and these devices are placed in the outer bulb (1).

As shown in FIG. 2, the discharge lamp having the abovementioned structure is connected through a ballast (22) to an electric power source (23) to apply the voltage of the power source whereby the discharge of the arc tube (8) is initiated to flow the current depending on the inductance of the ballast (22). The arc tube (8) reaches to the stable operating condition about 5 minutes after the initiation. Sometimes, the discharge in the discharge gap (13) continues for a moment at the initiation of the discharge of the arc tube (8). The discharge gap (13) is connected in series to an impedance element (17) having relatively high impedance (resistance) as 180 (Ω) so as to limit the current flown through the discharge gap (13) to 1 (A). When the arc current of 5-6 (A) begins to flow through the arc tube (8) at the starting, the voltage between the electrodes (10), (11) of the arc tube (8) reduces to 20-30 (V) and the voltage applied in the discharge gap (13) between the electrodes also reduces whereby the discharge in the discharge gap (13) stops and only the discharge of the arc tube (8) continues.

In the stable operating condition of the arc tube (8), the current of 3 to 4 (A) flows through the circuit of base (2)—stem lead (6), support frame (4)—ribbon lead (18)—lead (20)—electrode (11)—electrode (10)—lead (21)—ribbon lead (19)—support frame (3)—stem lead (5)—base (2) to the ballast. No current flows through the circuit of the discharge gap (13) and the impedance element (17) and the arc tube (8) continues the stable operation whereas the discharge gap (13) is kept in the non-operating condition.

When the arc tube (8) in the stable operating condition is once extinguished by a transient voltage drop of the power source etc. the restarting of the arc tube (8) is not immediately performed even though the voltage of the power source is returned to the normal level since the inner pressure of the arc tube (8) is increased to be about several atms. Thus, when the voltage of the power source is applied to the discharged lamp in the non-operating condition of the arc tube (8), the discharge gap (13) can be operable. When the arc tube (8) is extinguished, the discharge gap (13) is immediately operated to radiate whereby the radiation corresponding to the luminous characteristics of the discharge gap (13) is emitted without the complete extinction of the discharge lamp. During this period, the current controlled to 1 (A) by the impedance element (17) flows through the circuit of base (2)—stem lead (6)—support frame (4)—lead (14)—impedance (17)—electrode (16)—electrode (15)—support frame (3)—stem lead (5)—base (2) to the ballast (22). No current flows through the arc tube (8).

When the temperature of the arc tube (8) is lowered to reduce such a vapor pressure of the filled vapors especially mercury vapor in the arc tube as enables the restarting after certain period in the operating condition of the discharging in the discharge gap (13), the discharge of the arc tube (8) is restarted to reach to the stable operating condition after about 5 minutes following the restart for the desired electrical and optical characteristics. The restarting period of the arc tube (8) of this embodiment is about 10 minutes. In the discharge gap (13), when the discharge of the arc tube (8) is restarted, the discharge of the discharge gap (13) is stopped in the same manner as the starting of the arc tube. Therefore, the discharge gap (13) is not operated during the operation of the arc tube (8). In this embodiment, the distance of the discharge gap (13) is 3 mm. The distance of the discharge gap (13) should be shorter than a distance between the other metal exposed parts having a potential difference in the outer bulb (1). If the distance of the discharge gap (13) is larger than a distance between the other exposed parts, the discharge may cause at the other part in the outer bulb (1) instead of the discharge gap (13). This is disadvantageous in the practical application. The distance of the discharge gap (13) is preferably less than 4/5 of the minimum distance between the other parts.

Figure 3:
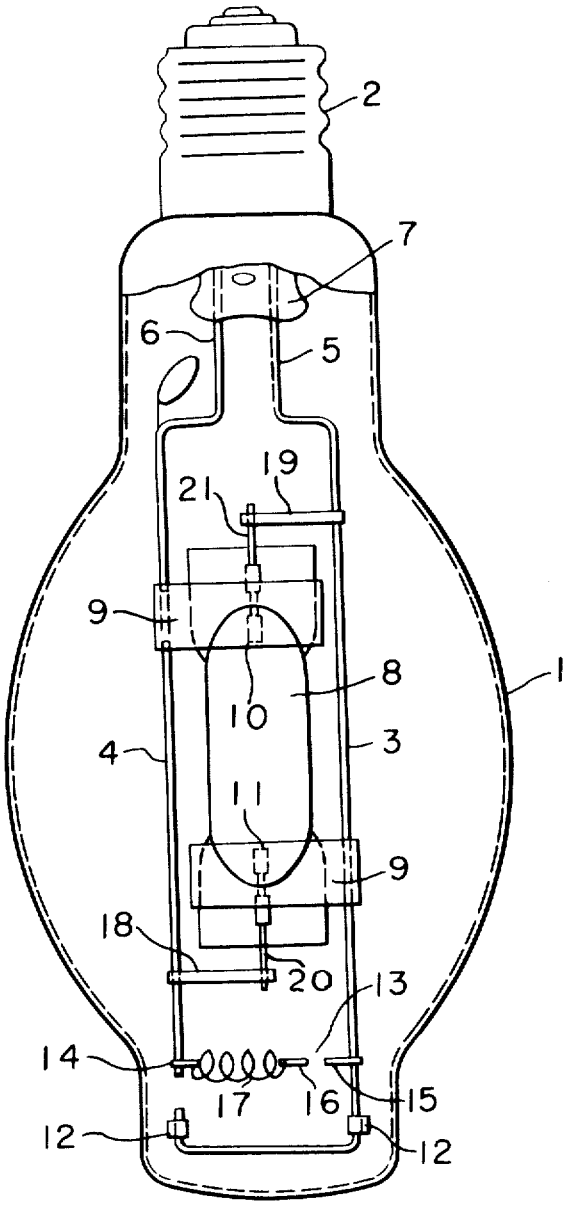
FIG. 3 is a front view of a discharge lamp as a second embodiment of the present invention.

FIG. 3 shows the second embodiment of the present invention, which has the same structure as the embodiment of FIG. 1 except that mercury and neon are filled under a pressure of 50 (torr) in the outer bulb and the phospher (24) is coated on the inner wall of the outer bulb (1).

In such structure, visible radiation is resulted by the discharge of the discharge gap (13) and the phospher (24) on the inner wall of the outer bulb (1) results in fluorescent emission by ultraviolet radiation resulted by the discharge of mercury whereby the radiation corresponding to characteristics of the discharge gap (13) is emitted without the complete extinction of the discharge lamp.

Figure 4:
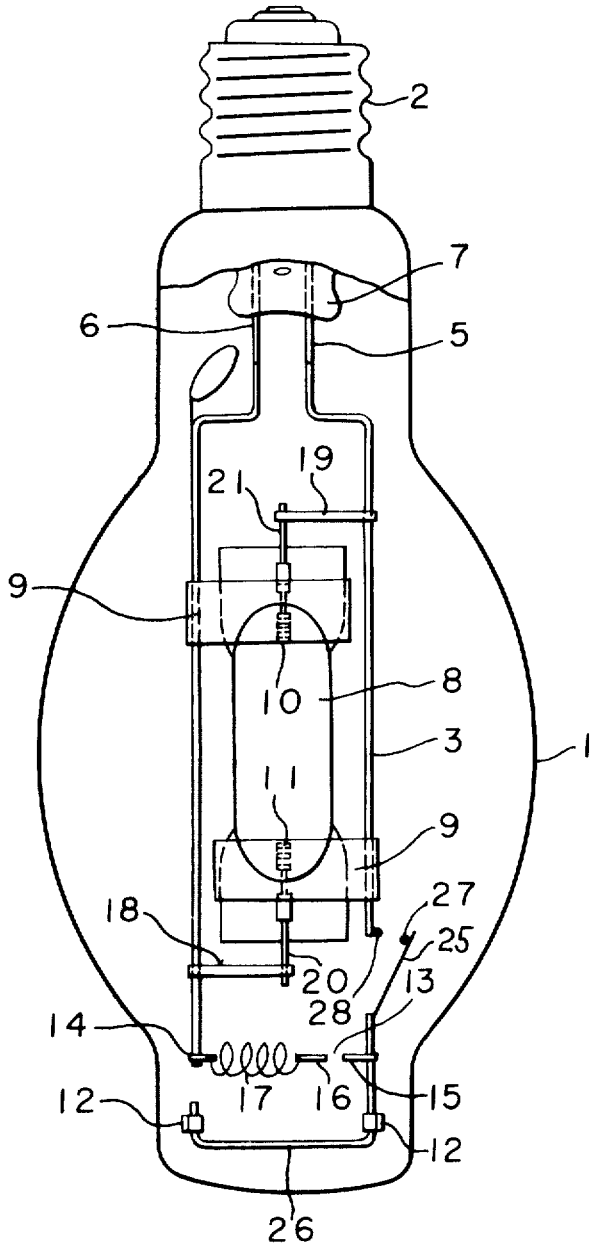
FIGS. 4 and 5 show a third embodiment of the present invention.
Figure 5:
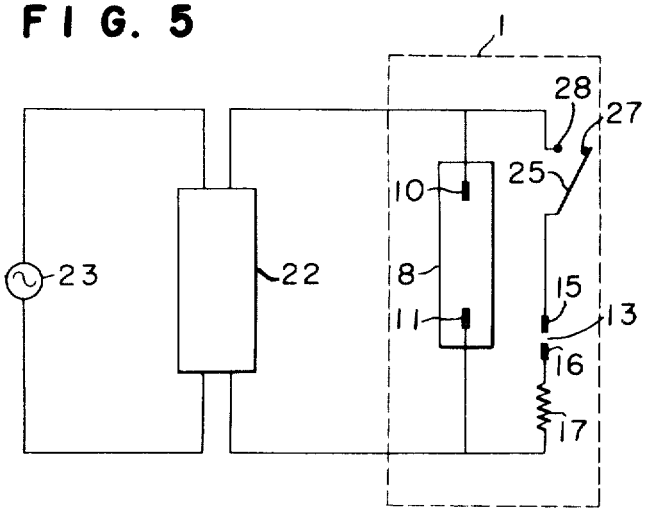

FIGS. 4 and 5 show the third embodiment of the present invention which has the same structure as the embodiment of FIG. 1 except that the reference numeral (25) designates a normally opened bimetallic switch which is connected to the support frame (26) at one end and also connected through contacts (27), (28) to the support frame (3) at the other end.

As shown in FIG. 5, the discharge lamp having such structure is connected through the ballast (22) to the power source (23) to apply the voltage of the power source whereby the discharge of the arc tube (8) is started to pass the current limitted by the ballast inductance (22) and the arc tube (8) reaches to the stable operating condition about 5 minutes after the starting of the discharge. When the discharge of the arc tube (8) is initiated the contacts (27), (28) of the normally opened bimetallic switch (25) are opened whereby any discharge in the discharge gap is not initiated.

In the stable operating condition of the arc tube (8), the current of about 3 to 4 (A) flows through the circuit of base (2)—stem lead (6)—support frame (4)—ribbon lead (18)—lead (20)—electrode (11)—electrode (10)—lead (21)—ribbon lead (19)—support frame (3)—stem lead (5)—base (2) to the ballast. No current flows through the circuit of the discharge gap (13) and the impedance element (17). The arc tube (8) is kept in the stable operating condition whereas the discharge gap (13) is kept in the non-operating condition.

During the stable operation, the bimetallic switch (25) is operated by heat of the arc tube (8) to maintain the contact of the contacts (27), (28).

When the arc tube (8) in the stable operating condition is once extinguished by a transient voltage drop of the power source etc., the restarting of the arc tube (8) is not immediately performed even though the power voltage is returned to the normal level since the inner pressure of the arc tube (8) is increased up to about several atm. Thus, when the voltage of the power source is applied to the discharge lamp in the non-operating condition of the arc tube (8), the discharge gap (13) can be operable. When the discharge of the arc tube (8) is extinguished, the discharge gap (13) is immediately operated to radiate whereby the radiation corresponding to the luminous characteristics of the discharge gap (13) is emitted without the complete extinction of the discharge lamp. During this period, the current controlled to 1 (A) by the impedance element (17) flows through the circuit of base (2)—stem lead (6)—support frame (4)—lead (14)—impedance element (17)—electrode (16)—electrode (15)—support frame (26)—bimetallic switch (25)—contacts (27), (28)—support frame (3)—stem lead (5)—base (5) to the ballast (22). No current flows through the arc tube (8). When the temperature of the arc tube (8) is lowered to reduce a vapor pressure of the filled vapors especially mercury vapor in the arc tube as enables the initiation of discharge after certain period following the initiation of the discharge in the discharge gap (13), the contacts (27), (28) of the bimetallic switch (28) are detached to stop the discharge in the discharge gap (13) and the discharge of the arc tube (8) is restarted to reach to the stable operating condition after about 5 minutes following it under the condition of the desired electrical and optical characteristics. The restarting period of the arc tube (8) of this embodiment is about 10 minutes. The discharge gap (13) is not operated during the operation of the arc tube (8).

In the first to third embodiments, the impedance element (17) is connected in series to the discharge gap (13). When glow discharge continues in the condition applying the voltage of the power source to the discharge gap (13), it is possible to connect the discharge gap (13) in parallel to the arc tube (8) without using the impedance element (17).

In the first to third embodiments, the arc tube of the 400 W metal halide vapor discharge lamp is used as the arc tube (8). Thus, it is not limited to the arc tube for 400 W but it can be an arc tube of different metal halide vapor discharge lamps or the high pressure mercury vapor discharge lamp or the high pressure sodium vapor discharge lamp. In said embodiment, neon is used as the filled gas in the outer bulb (1). Thus, it is possible to use the other inert gas such as argon, krypton, xenon and nitrogen or to seal the inert gas and mercury.

The pressure of the filled gas in the outer bulb (1) is preferably lower than 760 (torr) especially 1 to 200 (torr) so as to initiate the discharge in the discharge gap (13) by the normal voltage. These ones can be used. In said embodiments, a tungsten filament is used as the impedance element (17) connected in series to the discharge gap (13), it is possible to use a resistor, a capacitor, a choking coil, a filament coil or combinations of two or more of a capacitor, a choling coil, a filament coil and a resistor. The impedance of the impedance element (17) can be set depending upon the discharge characteristics of the discharge gap (13). When the filament coil is used as the impedance element (17), radiation is resulted from the filament coil during the operation of the discharge gap (13) until the restarting of the arc tube (8) to attain the effect of further radiation.

It is also possible to connect the arc tube to a solid resistor such as a tungsten filament which results in a radiation current, to compensate shortage of radiation at the starting of the arc tube. In such case, it is preferable to prevent energy loss by shortcircuiting the ends of the solid resistor by a bimetallic switch during the stable operating condition of the arc tube.

If necessary, the discharge lamp of the present invention is connected to a compact high frequency operating device (1 KHz–100 KHz) in one piece to form one lamp, whereby the discharge lamp can be operated by directly screwing into a socket to be easily used as the incandescent lamp.

The bimetallic switch (25) is the normally opened type. The contacts (27), (28) of the bimetallic switch do not contact at the starting of the lamp. During the stable operating condition of the arc tube, the bimetallic switch (25) is actuated by heat of the arc tube (8) to contact the contacts (27), (28). The contact condition is set to detach the contacts (27), (28) at the time of capable of the restarting followed by the extinction of the arc tube (8).

Figure 6:
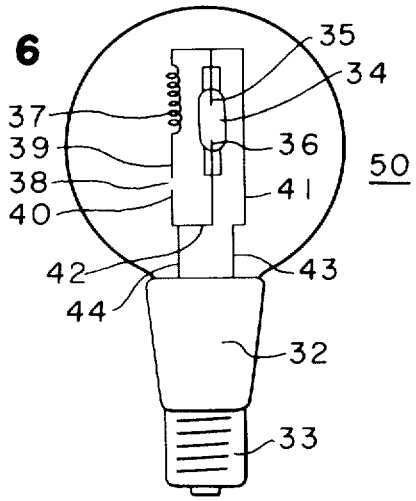
FIGS. 6 and 7 show a fourth embodiment of the present invention.
Figure 7:
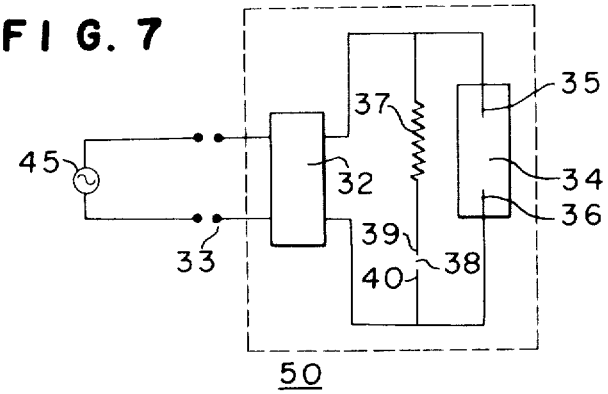

Referring to FIGS. 6 and 7, the fourth embodiment of the present invention will be illustrated.

In FIG. 6, the reference numeral (50) designates a lighting equipment comprising a light transmissive outer bulb (31), a high frequency operating device (32) and a base (33) in one piece. In the outer bulb (31), an arc tube (34), a tungsten filament (37) and a discharge gap (38) are placed. Electrodes (35), (36) are respectively placed at the ends of the arc tube (34). The one electrode (35) is connected to a support lead (41) and the other electrode (36) is connected through the lead (42) to the lead (44) of the operating device (32). The support lead (41) is connected to the other lead (43) of the operating device (32). The one electrode (39) of the discharge gap (38) between the electrodes (39), (40) is connected through the tungsten filament (37) to the support lead (41) and the other electrode (40) is connected through the lead (42) to the lead (44). Thus, the discharge gap (38) connected in series to the filament (37) is electrically connected in parallel to the arc tube (34). The lead of the operating device (32) in the power source side is connected to the base (33). The arc tube (34) is an arc tube of a 30 W metal halide vapor discharge lamp and mercury, argon and halides of scandium and sodium are filled in the arc tube. A distance between the electrodes (39), (40) of the discharge gap (38) is 3 mm and 50 (torr) of neon gas is filled in the outer bulb.

The tungsten filament (37) as the impedance element is set to be 400 (Ω) so as to limit the current of the discharge gap (38) to be 0.2 (A). A rare gas is filled in the outer bulb (31) so as to prevent the evaporation of the tungsten of the filament (39) and the oxidation of the parts in the outer bulb.

As shown in FIG. 7, when the lighting equipment having such structure is connected to the power source (45), the high frequency voltage generated by the high frequency operating device (32) is applied to the arc tube whereby the discharge of the arc tube (34) is started to flow the high frequency current of 20 KHz which is generated and controlled by the operating device (32) through the arc tube (34) and the arc tube (34) reaches to the stable operating condition about 3 minutes after the initiation. Sometimes, the discharge in the discharge gap (38) results for a moment at the initiation of the discharge of the arc tube (34). The discharge gap (38) is connected in series to an impedance element (37) having relatively high impedance as 400 (Ω) (the filament as resistor) so as to limit the current flown through the discharge gap to 0.2 (A). When the arc current of 0.6 to 0.65 (A) begins to flow through the arc tube (34) at the initiation, the voltage between the electrodes (35), (36) of the arc tube (34) reduces to about 20 (V) and the voltage between the electrodes (39), (40) of the discharge gap (38) also reduces whereby the discharge in the discharge gap (38) stops and only the discharge of the arc tube (34) continues.

In the stable operating condition of the arc tube (34), the current is passed through the circuit of base (33)—operating device (32)—lead (43)—support lead (41)—electrode (35)—electrode (36)—lead (42)—lead (44)—operating device (32)—base (33). Any current is not passed through the circuit of the discharge gap (38) and the impedance element (37), and the arc tube (34) continues the stable operation whereas the discharge gap (38) is kept in the non-operating condition.

When the arc tube (34) in the stable operating condition is once extinguished by a transient voltage drop of the power source etc., the restarting of the arc tube (34) is not immediately performed even though the voltage of the power source is returned to the normal level since the inner pressue of the arc tube is increased up to about several atm. Thus, when the voltage of the power source is applied to the discharge lamp in the non-operating condition of the arc tube (34), the discharge gap (38) can be operable. When the arc tube (38) is extinguished, the discharge gap (38) is immediately operated to radiate from the discharge gap (38) and the tungsten filament (37) whereby the radiation corresponding to the radiation characteristics of the discharge gap (38) and the filament (37) is emitted without the complete extinction of the discharge lamp. During this period, the high frequency current controlled to 0.2 (A) by the filament (37) as the impedance element is passed through the discharge gap (38) by passing the current through the circuit of base (33)—operating device (32)—lead (43)—support lead (41)—filament (37) as impedance element—electrode (39)—electrode (40)—lead (42)—lead (44)—operating device (32)—base (33). Any current is passed through the arc tube (34).

When the temperature of the arc tube (34) is lowered to reduce a vapor pressure of the filled vapors especially mercury vapor in the outer bulb as enables the restarting after certain period following the initiation of the discharging in the discharge gap (38), the discharge of the arc tube (34) is restarted to reach to the stable operating condition after about 3 minutes following it under the condition of the desired electrical and optical characteristics. The restarting period of the arc tube (34) is about 8 minutes. In the discharge gap (38), when the discharge of the arc tube (34) is restarted, the discharge of the discharge gap (38) is stopped in the same manner as the starting of the arc tube. Therefore, the discharge gap (38) is not operated during the operation of the arc tube (34).

Table 1 shows characteristics of the 30 W metal halide vapor discharge lamp and the 100 W incandescent lamp as reference. As it is clear from Table 1, the 30 W metal halide vapor discharge lamp has more than 3 times of the efficacy and more than 5 times of life of the incandescent lamp. In Table 1, the luminous efficacy is given by a ratio of total luminous fluxes to a power of a lamp as the efficacy for only the lamp. The overall efficacy is given by a ratio of total luminous fluxes to an input power which includes the power loss of the ballast. The 30 W metal halide vapor discharge lamp of the invention is operated on the high frequency of 20 KHz whereby the power loss caused by the operating device is lower than that of the ballast of the common discharge lamp. The input power is 34 W.

TABLE 1

| | 100 W incandescent lamp | 30 W metal halide vapor discharge lamp |
|---|---|---|
| Power of lamp (W) | 100 | 30 |
| Voltage of lamp (V) | — | 60 |
| Current of lamp (A) | — | 0.56 |
| Total luminous fluxes (lm) | 1520 | 1500 |
| Color temperature (K) | 2800 | 3300 |
| Luminous efficacy (lm/W) | 15.2 | 50 |
| Overall efficacy (lm/W) | 15.2 | 44.1 |
| Life (Hr) | 1000 | 5000 |

Figure 8:
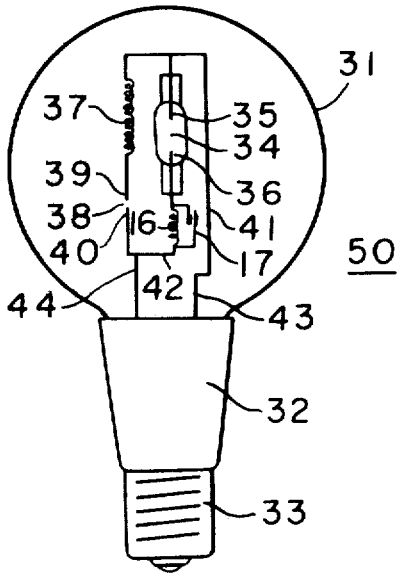
FIGS. 8 and 9 show a fifth embodiment of the present invention.
Figure 9:
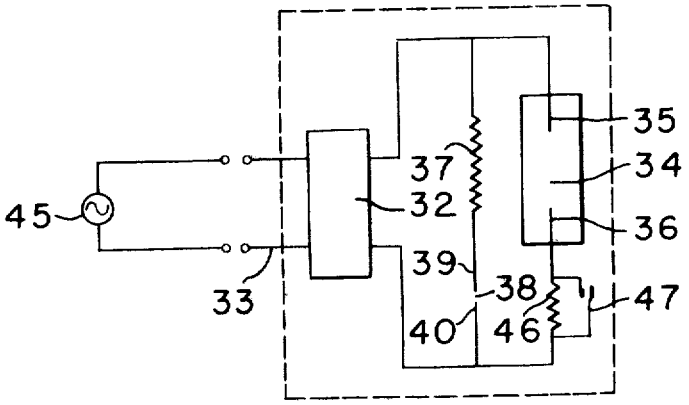

FIGS. 8 and 9 show the fifth embodiment of the present invention which has the same structure as the embodiment of FIGS. 8 and 9 except that a tungsten filament (46) is connected in series to the arc tube (34) and a bimetallic switch (47) is connected in parallel to both ends of the tungsten filament (46).

The filament (46) as the solid resistor is heated by the current at the starting of the arc tube (34) to radiate whereby the stable operation of the arc tube (34) is attained for shorter time and the radiation from the resistor can be utilized in addition to that from the arc tube.

As shown in FIG. 9, when the lighting equipment having such structure is connected to the power source (45), the high frequency voltage generated by the high frequency operating device (32) is applied to the arc tube to initiate the discharge of the arc tube (34) whereby the current limited by the operating device (32) is flown through the arc tube (34) and the tungsten filament (46). The arc tube (34) reaches to the stable operating device about 2 minutes after the initiation. Sometimes, the discharge in the discharge gap (38) continues for a moment at the initiation of the discharge of the arc tube (34). The discharge gap (38) is connected in series to the impedance element (37) having relatively high impedance as 400 (Ω) (the filament as resistor) so as to limit the current flown through the discharge gap to 0.2 (A) begins to flow through the arc tube (34) at the starting, the voltage between the electrodes (35), (36) of the arc tube (34) reduces to about 20 (V) and the voltage between the electrodes (39), (40) of the discharge gap (38) also reduces whereby the discharge in the discharge gap (38) stops and only the discharge of the arc tube (34) continues.

At the starting of the arc tube (34), the current is passed through the circuit of base (33)—operating device (32)—lead (42)—support lead (41)—electrode (35)—electrode (36)—tungsten filament (46)—lead (42)—lead (44)—operating device (32)—base (33).

In the stable operating condition of the arc tube (34), both terminals of the tungsten filament (46) are shortcircuited by the bimetallic switch (47) to pass the current through the circuit of base (33)—operating device (32)—lead (43)—support lead (41)—electrode (35)— electrode (36)—bimetallic switch (47)—lead (42)—lead (44)—operating device (32)—base (33). Any current is not passed through the circuit of the discharge gap (38) and the tungsten filament (37) as the impedance element. The arc tube (34) is kept in the stable operating condition whereas the discharge gap (38) is kept in the non-operating condition.

When the arc tube (34) in the stable operating condition is once extinguished by a transient voltage drop of the power source etc., the restarting of the arc tube (34) is not immediately performed even though the voltage of the power source is returned to the normal level since the inner pressure of the arc tube is increased up to about several atm. Thus, when the voltage of the power source is applied to the discharge lamp in the non-operating condition of the arc tube (34), the discharge gap (38) can be operable. When the arc tube (38) is extinguished, the disharge gap (38) is immediately operated to radiate from the discharge gap (38) and the tungsten filament (37) whereby the radiation corresponding to the luminous characteristics of the discharge gap (38) and the filament (37) is emitted without the complete extinction of the discharge lamp. During this period the high frequency current limited to 0.2 (A) by the filament (37) as the impedance element is flown through the discharge gap (38) by passing the current through the circuit of base (33)—operating device (32)—lead (43)—support lead (41)—filament (37) as the impedance element—(37) as the impedance element—electrode (39)—electrode (40)—lead (42)—lead (44)—operating device (32)—base (33). Any current is not passed through the arc tube (34).

When the temperature of the arc tube (34) is lowered to reduce a vapor pressure of the filled vapors especially mercury vapor in the arc tube as enables the restarting after certain period following the initiation of the discharge in the discharge gap (38), the discharge of the arc tube (34) is restarted to reach to the stable operating condition after about 2 minutes following it under the condition of the desired electrical and optical characteristics. The restarting period of the arc tube (34) is about 8 minutes. In the discharge gap (38), when the discharge of the arc tube (34) is restarted, the discharge of the discharge gap (38) is stopped in the same manner as the starting of the arc tube. Therefore, the discharge gap (38) is not operated during the operation of the arc tube (34).

In the fourth and fifth embodiments, the tungsten filament (37) as the impedance element is connected in series to the discharge gap (38). When glow discharge continues in the condition applying the voltage of the power source to the discharge gap (38), it is possible to connect the discharge gap (38) in parallel to the arc tube (34) without using the impedance element (37).

In the fourth and fifth embodiments, the arc tube of the 30 W metal halide vapor discharge lamp is used as the arc tube (34). Thus, it is not limited to the arc tube for 30 W but it can be an arc tube of different metal halide vapor discharge lamps or the high pressure mercury vapor discharge lamp or the high pressure sodium vapor discharge lamp. In said embodiment, neon is used as the filled gas in the outer bulb. Thus, it is possible to use the other inert gas such as argon, krypton, xenon and nitrogen or to seal the inert gas and mercury.

The pressure of the filled gas in the outer bulb is preferably lower than 760 (torr) especially 1 to 200 (torr) so as to start the discharge in the discharge gap (38) by the normal voltage. These ones can be used.

In said embodiments, a tungsten filament is used as the impedance element (37) connected in series to the discharge gap (38), it is possible to use a resistor, a capacitor, a choking coil, a filament coil or combinations of two or more of a capacitor, a choking coil, a filament coil and a resistor. The impedance of the impedance element (37) can be set depending upon the discharge characteristics of the discharge gap (38), radiation is resulted from the filament coil during the operation of the discharge gap (38) until the restarting of the arc tube (34) to attain the effect of further radiation.

The frequency of the voltage or the current for operating the arc tube (34) or the discharge gap (38) which are generated by the high frequency operating device (32) of the present invention is 20 KHz in said embodiment and can be in a range of 1 to 100 KHz. When it is less than 1 KHz, the operating device can not be compact size as desired whereas when it is greater than 100 KHz, the arc extinction phenomenon caused by unstable discharge at the starting of the arc tube is found to cause a trouble in a practical application.

In the fourth and fifth embodiments, the color temperature of the 30 W metal halide vapor discharge lamp is 3300 K. When this is used instead of the incandescent lamp which usually has the color temperature of about 2800 K, the color temperature of the discharge lamp is preferably in a range of 2000 K to 3600 K as 2800±800 K. When the color temperature is out of said range, the difference of the color temperature from that of the incandescent lamp is too large and certain different feeling is disadvantageously given.

In the fifth embodiment, the tungsten filament is used as the solid resistor (46) connected in series to the arc tube (34). Thus, the solid resistor is not limited to the tungsten filament and can be any other resistor which emits light by current to add luminous flux at the initiation of the arc tube (34) so as to compensate the low luminous flux at the initiation of the arc tube (34).

In the fifth embodiment, the bimetallic switch is used as temperature responsive switch for shortcircuiting both ends of the tungsten filament as the solid resistor in the stable operation of the arc tube. Thus, it is possible to shortcircuit it by the other means. Thus, radiation is resulted from the solid resistor only at the initiation of the arc tube so as to overcome the disadvantage of the arc tube which slowly reaches to the stable operation to give a predominant luminous flux from the time just after starting the arc tube. During the stable operation, the lighting resulted by passing the current through the solid resistors is stopped to prevent the loss of electric power caused by the solid resistor having low efficacy but to operate only the arc tube having high efficacy.

We claim:

1. A discharge lamp which comprises an arc tube for high pressure discharge and a discharge gap for discharging until restarting said arc tube and said discharge gap being electrically connected in parallel to said arc tube in an outer bulb wherein mercury is kept in said outer bulb and a phosphor is coated on an inner surface of said outer bulb.

2. The discharge lamp according to claim 1 wherein said arc tube is an arc tube of a high pressure mercury discharge lamp, a metal halide vapor discharge lamp, or a high pressure sodium vapor discharge lamp.

3. The discharge lamp according to claim 1 or 2 wherein an inert gas or a combination of an inert gas and mercury is kept in said outer bulb.

4. The discharge lamp according to claim 1 wherein a normally opened temperature responsive switch means is connected in series to said discharge gap and a series of said discharge gap and said temperature responsive switch means is connected in parallel to said arc tube.

5. The discharge lamp according to claim 4 wherein an inert gas or a combination of an inert gas and mercury is kept in said outer bulb.

6. The discharge lamp according to claim 4, or 5 wherein said temperature responsive switch means is a bimetallic switch.

7. The discharge lamp according to claim 1 wherein an inert gas is filled in said outer bulb.

8. The discharge lamp according to claim 1 wherein a distance of said discharge gap is shorter than a distance between two metal exposed parts having a potential in said outer bulb.

9. The discharge lamp according to claim 8 wherein an inert gas or a combination of an inert gas and mercury is kept in said outer bulb.

10. A discharge lamp which comprises an arc tube for high pressure discharge and a discharge gap for discharging until restarting said arc tube and said discharge gap being electrically connected in series to an impedance device and in parallel to said arc tube in an outer bulb wherein a normally open temperature responsive switch means is connected in series to said discharge gap and a series of said discharge gap and said temperature responsive switch means is connected in parallel to said arc tube.

11. The discharge lamp according to claim 10 wherein said impedance device is a resistor.

12. The discharge lamp according to claim 10 wherein said impedance device is a filament coil.

13. The discharge lamp according to claim 10 wherein said arc tube is an arc tube of a high pressure mercury vapor discharge lamp, a metal halide vapor discharge lamp or a high pressure sodium vapor discharge lamp.

14. The discharge lamp according to claim 10 wherein an inert gas or a combination of an inert gas and mercury is kept in said outer bulb.

15. The discharge lamp according to claim 10, 11, 12, 13 or 14 wherein said temperature responsive switch means is a bimetallic switch.

16. The discharge lamp according to claim 15 wherein a distance of said discharge gap is shorter than a distance between two metal exposed parts having a potential in said outer bulb.

17. The discharge lamp according to claim 16 wherein an inert gas or a combination of an inert gas and mercury is kept in said outer bulb.

18. The discharge lamp according to claim 10 wherein mercury is kept in said outer bulb and a phospher is coated on an inner wall of said outer bulb.

19. The discharge lamp according to claim 18 wherein said arc tube is an arc tube of a high pressure mercury vapor discharge lamp, a metal halide vapor discharge lamp or a high pressure sodium vapor discharge lamp.

20. The discharge lamp according to claim 18 or 19 wherein an inert gas is filled in said outer bulb.

21. A discharge lamp which comprises an arc tube for high pressure discharge and a discharge gap for discharging until restarting said arc tube and said discharge gap being electrically connected in series to an impedance device and in parallel to said arc tube in an outer bulb wherein a radiative solid resistor is connected in series to said arc tube.

22. The discharge lamp according to claim 21 wherein both terminals of said solid resistor are shortcircuited during a stable operation of said arc tube.

23. The discharge lamp according to claim 22 wherein a temperature responsive means is used as a means for shortcircuiting said solid resistor.

24. The discharge lamp according to claim 23 wherein said solid resistor is a tungsten filament.

* * * * *